US006022135A

United States Patent [19]

Williams

[11] Patent Number: 6,022,135

[45] Date of Patent: Feb. 8, 2000

[54] FLUID MIXING DEVICE

[75] Inventor: Keith Williams, Middlewich, United Kingdom

[73] Assignee: Copes-Vulcan Limited, United Kingdom

[21] Appl. No.: 08/987,456

[22] Filed: Dec. 9, 1997

[30] Foreign Application Priority Data

Dec. 10, 1996 [GB] United Kingdom ..... 9625607

[51] Int. Cl.[7] ..... B01F 15/00

[52] U.S. Cl. ..... 366/174.1; 366/182.4

[58] Field of Search ..... 366/181.5, 182.4, 366/182.3, 182.1, 174.1, 167.1, 175.2, 366, 344; 239/541; 251/63.6, 83; 137/540, 541

[56] References Cited

U.S. PATENT DOCUMENTS

| | | | |
|---|---|---|---|
| 144,844 | 11/1873 | Gould | 137/541 |
| 646,902 | 4/1900 | Haeberle | 137/541 |
| 995,005 | 6/1911 | Holsman | 137/541 |
| 1,260,663 | 3/1918 | Gould | 137/541 |
| 1,629,495 | 5/1927 | Frankenberg | 137/541 |
| 1,721,666 | 7/1929 | Lee | 137/541 |
| 1,982,294 | 11/1934 | Griffin | 137/541 |
| 2,155,124 | 4/1939 | Gibbons | 137/541 |
| 3,335,751 | 8/1967 | Davis, Jr. | 137/541 |
| 3,693,656 | 9/1972 | Sauer | 366/182.4 |
| 4,812,049 | 3/1989 | McCall | 366/174.1 |
| 5,176,448 | 1/1993 | King et al. | 366/174.1 |
| 5,372,283 | 12/1994 | Schmitkons et al. | 366/182.4 |

FOREIGN PATENT DOCUMENTS

| | | |
|---|---|---|
| 1151016 | 5/1969 | United Kingdom . |
| 2050816A | 1/1981 | United Kingdom . |

*Primary Examiner*—Tony G. Soohoo
*Attorney, Agent, or Firm*—Barnes &Thornburg

[57] ABSTRACT

A fluid mixing device, especially for treating super heated steam comprises a conduit (10) for a first fluid with a dispersing member (14) for a second fluid, such as water, arranged so that an annular space (16) is defined between the dispersing member (14) and the internal surface of the conduit (10). The dispersing member (14) comprises first and second parts (24, 26) mounted for relative movement. An outlet (62) for the second fluid is defined between the first and second parts (24, 26). The site of the outlet (62) is defined by relative movement between the parts (24, 26). The relative movement is determined by the rate of flow of the first fluid through the conduit (10).

20 Claims, 2 Drawing Sheets

FLUID MIXING DEVICE

The invention relates to a fluid mixing device and is primarily concerned with a fluid mixing device in the form of a desuperheater for reducing steam temperature by introducing water into a flow of superheated steam.

Fluid mug devices of the above type are known and comprise a conduit for a first fluid such as steam having therein a dispersing member for a second fluid such as water. The dispersing member is arranged so that an annular space is defined between the dispersing member and the internal surface of the conduit. The dispersing member has an outlet for the second fluid which enables the second fluid to be drawn from the dispersing member and dispersed in the first fluid.

The dispersing member is preferably arranged to induce turbulence in the first fluid to promote rapid mixing of the first and second fluids in the conduit.

An object of the present invention is to provide an improved fluid mixing device which will enable the second fluid to be introduced into the first fluid more effectively.

According to the invention there is provided a fluid mixing device comprising a conduit for a first fluid having therein a dispersing member for receiving a second fluid and arranged so that an annular space is defined between the dispersing member and the internal surface of the conduit, the dispersing member comprising a first part and a second part mounted for movement relative to the first part, an outlet for the second fluid being defined between the first and second parts, the size of the outlet being variable by movement of the second part relative to the first part.

Movement of the second part relative to the first part for varying the size of the outlet enables the flow of second fluid from the dispersing member to be varied by increasing or decreasing the size of the outlet in response to increasing or decreasing rate of first fluid flow through the conduit.

The second part is preferably arranged to move against a resilient bias to increase the size of the outlet. The resilient bias may be provided by one or more springs which are preferably in the form of Belleville washers.

The outlet is preferably annular and may be defined between a peripheral edge of the first part and a peripheral edge of the second part. To increase the size of the outlet, the second part is moved relative to the first part to move the peripheral edges apart.

Fluid is preferably fed to the dispersing member by means of a valve which permits rate of flow of the second fluid to the dispersing member to increase with increasing rate of flow of the first fluid. Increasing flow of the second fluid is preferably arranged to urge the second part away from the first part to increase the size of the outlet.

Preferably, the first part is hollow and may be in the form of a cylindrical member. The hollow first part may have a transverse wall therein on which the second part is movably mounted. The transverse wall may be provided with one or more passageways to enable the second fluid to flow from the interior of the hollow first part to the outlet defined between the first and second parts. The second part is preferably mounted on a shaft which extends through an aperture in the transverse wall, the shaft being movable through the aperture against the aforesaid resilient bias to enable the second part to move away from the first part and increase the size of the outlet.

The second part may take the form of a frustum of a cone, the outlet being defined between the larger end of the second part and an adjacent surface of the first part.

A fluid mixing device in accordance with the invention will now be described by way of example with reference to the accompanying drawings in which:

Figure 1:
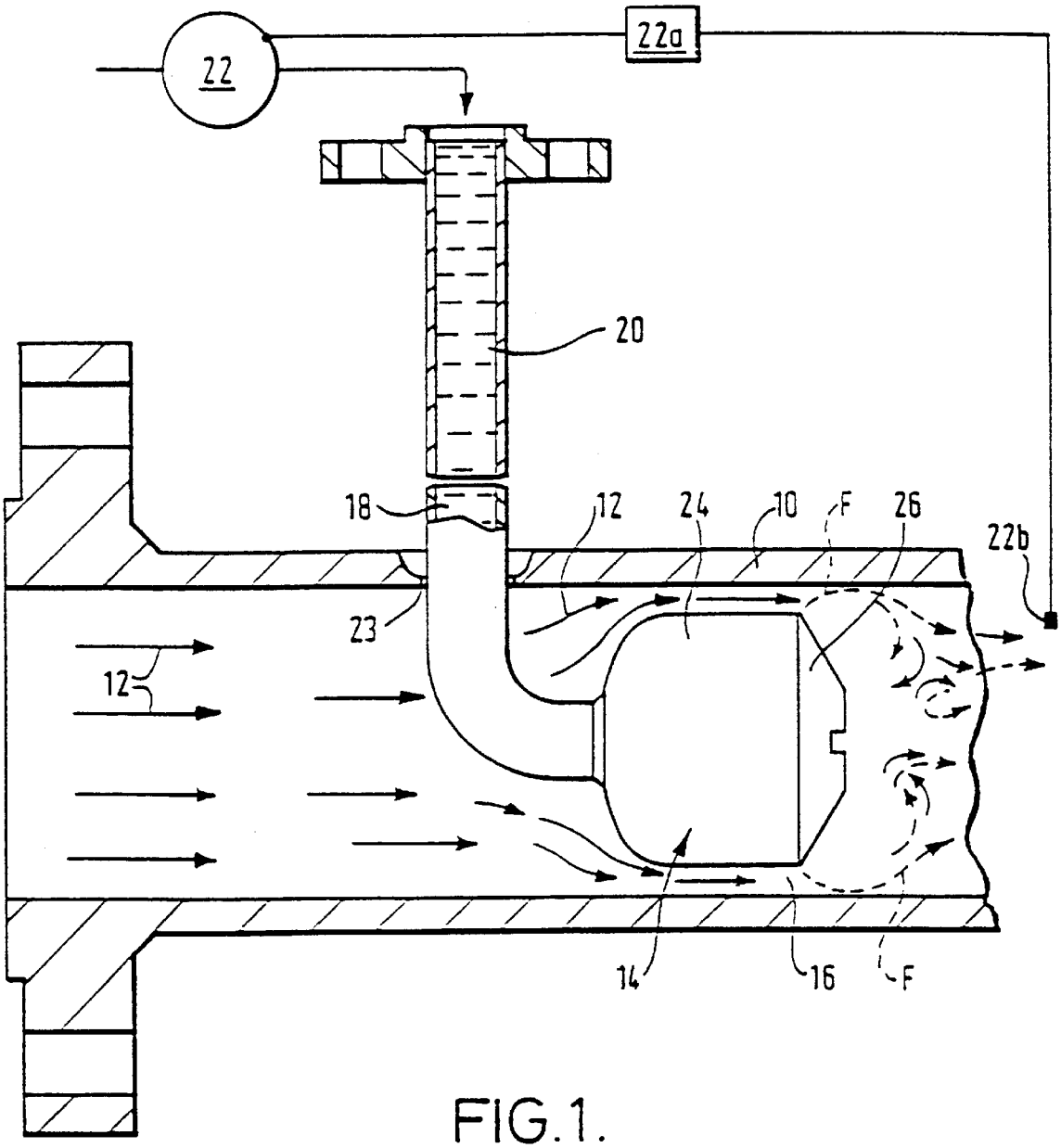
FIG. 1 is a cross section through part of a fluid mixing device in accordance with the invention in the form of a desuperheater.

Looking at FIG. 1, a conduit 10 of circular cross section receives superheated steam 12 from a source not shown. A dispersing member 14 for water is suitably mounted in the conduit 10 so that an annular space 16 is defined between the outer periphery of the dispersing member 14 and the adjacent internal surface of the conduit 10.

The dispersing member is connected to an inlet pipe 18 which is connected to a supply (not shown) of water 20 via a valve 22. The pipe 18 passes through an aperture 23 in the conduit 10 and sweeps round so as to extend coaxially of the pipe 10 for connection to the upstream side of the dispersing member 14. The valve 22 is connected to a controller 22*a* which receives a signal from a temperature sensor 22*b* arranged to sense temperature downstream of the dispersing member 14. The signal received by the controller 22*a* is compared to a set value and the controller 22*a* is arranged to control the opening of valve 22 in order to maintain the downstream temperature at a desired value.

Figure 2:
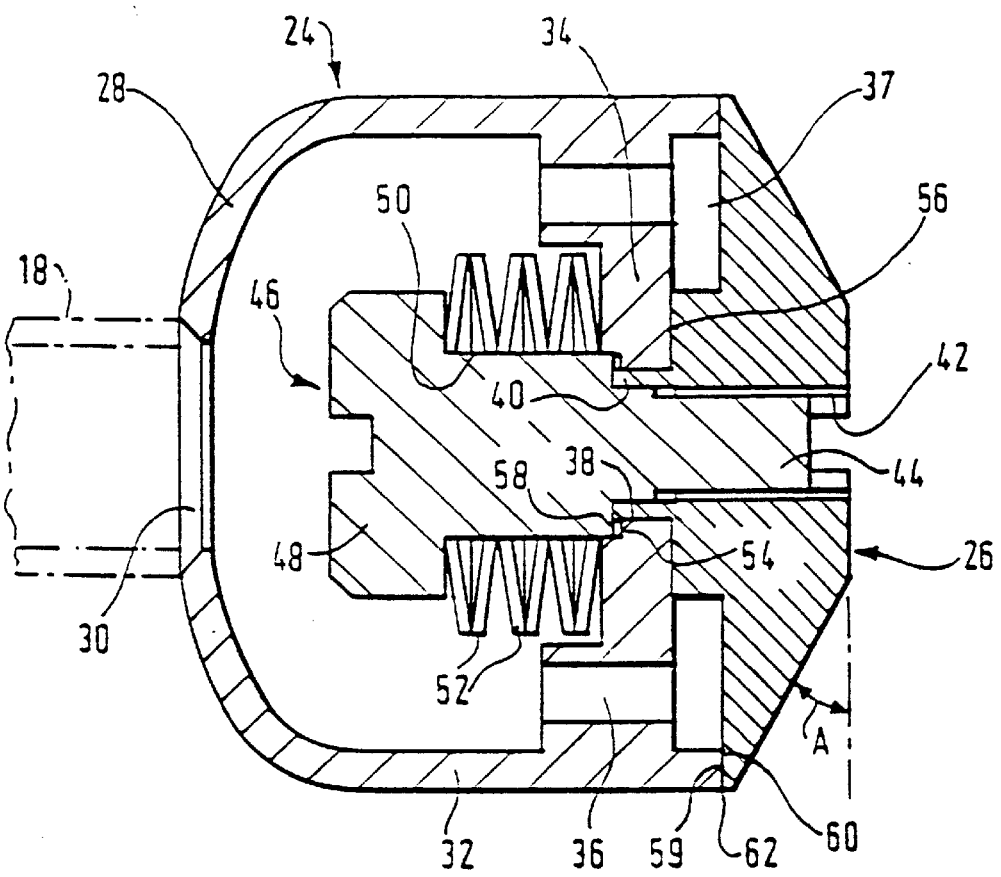
FIG. 2 is a cross section through a dispersing member of the device shown in FIG. 1
Figure 3:
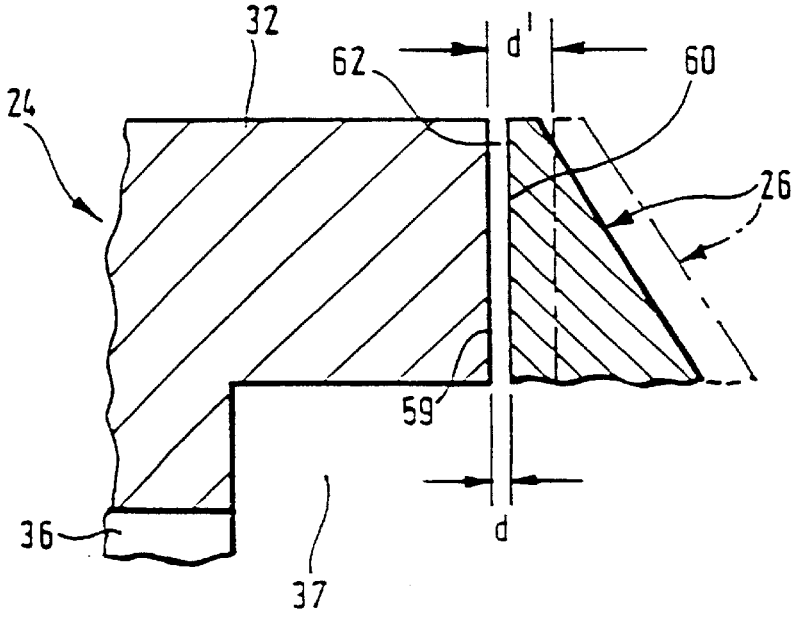
FIG. 3 is a diagrammatic view to a larger scale illustrating movement of the second part to vary the size of the outlet.

As shown in FIG. 2, the dispersing member 14 comprises a hollow cylindrical first part 24 and a second part 26 generally in the form of a frustum of a cone. The first part 24 is coaxial with the conduit 10 and has a curved upstream wall 28 formed with an aperture 30 which receives water from the pipe 18. A cylindrical wall 32 of the first part 24 has a transverse closure wall 34 therein formed with a plurality of equi-spaced axially extending passages 36 leading to an annular chamber 37 between the first and second parts 24, 26. For example, eight passageways 36 may be provided in some embodiments. The closure wall 34 has a central aperture 38 which slidably locates an annular axial extension 40 of the frustoconical second part 26. The second part 26 is formed with a screw threaded central bore 42 into which a screw threaded shank 44 of a mounting bolt 46 is screwed. The mounting bolt 46 has a slotted head 48 and a cylindrical section 50. Six Belleville washers 52 are slidably mounted on the cylindrical section 50 so as to be pre-compressed between the closure wall 34 and the bolt head 48. Fewer or more than six Belleville washers may be used. The cylindrical section 50 extends into a counterbore 54 in the closure wall 34 and abuts the tree end of the annular extension 40 of the frustoconical second part 26. In that position, the bias created by the Belleville washers 52 urges a stop face 56 of the frustoconical second part 26 against the right hand side of the closure wall 34 as viewed in FIG. 2 so as to leave an axial space 58 between the bottom of the counterbore 54 and the right hand end of the cylindrical section 50. In that position, a peripheral annular end face 59 of the cylindrical wall 32 is spaced from a peripheral surface part 60 of the frustoconical second part 26 by a small distance d (see FIG. 3) which may be around 0,05 mm (0.002 inches). In FIG. 3, the space d is shown exaggerated in size for clarity and provides an annular outlet 62.

The operation of the device will now be described.

With the pipe 18 connected to the supply of water via the valve 22, superheated steam 12 flows through the conduit 10. As the steam 12 encounters the upstream surface 28 of the dispersing member 14, the steam is forced into the annular space 16 so as to flow at high speed through the annular space along the cylindrical surface of the first part 24. As the steam passes over the outlet 62 water 20 is drawn through the outlet 62 as a thin annular film indicated at F in FIG. 1. As the flow rate of the superheated steam 12 changes, there will be a resulting change in temperature detected by the sensor 22*b*. The controller 22*a* will operate to control the valve 22 to permit the flow of water 20 to the dispersing member 14 to increase or decrease as appropriate thereby increasing or decreasing the pressure in the annular chamber 37. Increased pressure in the chamber 37 causes the frustoconical second part 26 to move away from the first part 24 against the bias of the Belleville washers 52 thereby increasing the distance d between the surfaces 59, 60 to, say, d' as shown in broken lines in FIG. 3. In that way, the size of the outlet 62 increases in response to increasing flow of superheated steam 12. The amount of movement of the frustoconical second part 26 permits the distance d to increase to a maximum of around 1 mm (0.040 inches). A subsequent decrease in pressure in chamber 37 causes the frustoconical second part to be drawn back towards the first part by the Belleville washers 52.

Although the water 20 leaves the outlet 62 substantially in the form of an annular film F, the frustoconical form of the second part 26 induces turbulence in the flow of superheated steam 12 immediately downstream of the dispersing member 24 which promotes rapid mixing of the steam 12 with the water leaving the outlet 62. We have found that inclining the external conical surface of the second part 26 at an angle A of 30 degrees to a radial plane is particularly suitable for inducing the turbulence required.

Where the required rate of water flow through the outlet 62 decreases, the pressure in the chamber 37 also decreases thereby permitting the frustoconical second part 26 to move back towards its initial position thereby reducing the size of the outlet 62.

The invention is particularly useful in that the use of an annular outlet 62 provides water flow into the stream of superheated steam substantially over the film circumference of the dispersing member 14 which provides optimum mixing of steam and water.

Whilst specific reference has been made to the mixing of water and steam, the device could be used for desuperheating gas by using water to cool the flow of gas or by causing liquified gas to flow through the outlet 62 into a stream of gas to be cooled.

I claim:

1. A fluid mixing device comprising a conduit for a first fluid having therein a dispersing member for receiving a second fluid and arranged so that an annular space is defined between the dispersing member and the internal surface of the conduit, the dispersing member being arranged to induce turbulence in the first fluid downstream thereof and comprising a first part and a second part mounted for movement relative to the first part, an outlet for the second fluid being defined between the first and second parts, the size of the outlet being variable by movement of the second part relative to the first part in response to increasing or decreasing rate of flow of the first fluid through the conduit.

2. A fluid mixing device according to claim 1 in which the second part is arranged to move against a resilient bias to increase the size of the outlet.

3. A fluid mixing device according to claim 2 further comprising at least one spring positioned to provide the bias of the second part.

4. A fluid mixing device according to claim 3, wherein the spring is a Belleville washer.

5. A fluid mixing device according to claim 1 in which the outlet is annular.

6. A fluid mixing device according to claim 5 in which the outlet is defined between a peripheral edge of the first part and a peripheral edge of the second part.

7. A fluid mixing device according to claim 1 in which the second fluid is fed to the dispersing member by means of a valve.

8. A fluid mixing device according to claim 7, further comprising a sensor positioned within the conduit to measure the rate of flow of the first fluid and generate a signal and a controller coupled to the sensor to receive the signal therefrom and the valve to instruct the valve to increase the rate of flow of the second fluid in response to increasing rate of flow of the first fluid.

9. A fluid mixing device according to claim 1 in which increasing rate of flow of the second fluid is arranged to urge the second part away from the first part to increase the size of the outlet.

10. A fluid mixing device according to claim 1 in which the first part is hollow and may be in the form of a cylindrical member.

11. A fluid mixing device according to claim 10 in which the hollow first part has a transverse wall therein on which the second part is movably mounted.

12. A fluid mixing device according to claim 11 in which the transverse wall is provided with one or more passageways to enable the second fluid to flow from the interior of the hollow first part to the outlet defined between the first and second parts.

13. A fluid mixing device according to claim 12 in which the second part is mounted on a shaft which extends through an aperture in the transverse wall, the shaft being movable through the aperture against the aforesaid resilient bias to enable the second part to move away from the first part and increase the size of the outlet.

14. A fluid mixing device according to claim 11 in which the second part is mounted on a shaft which extends through an aperture in the transverse wall, the shaft being movable through the aperture against the aforesaid resilient bias to enable the second part to move away from the first part and increase the size of the outlet.

15. A fluid mixing device according to claim 1 in which the second part is in the form of a frustum of a cone, the outlet being defined between the larger end of the second part and an adjacent surface of the first part.

16. A fluid mixing device comprising a conduit for a first fluid comprising a superheated gas or vapor having therein a dispersing member for receiving a second fluid comprising a cooling fluid and arranged so that an annular space is defined between the dispersing member and the internal surface of the conduit, the dispersing member comprising a first part and a second part mounted for movement relative to the first part, an outlet for the second fluid being defined between the first and second parts, the size of the outlet being variable by movement of the second part relative to the first part in response to increasing or decreasing rate of flow of the first fluid through the conduit.

17. A fluid mixing device according to claim 16, wherein the dispersing member is arranged to induce turbulence in the first fluid downstream thereof.

18. A fluid mixing device according to claim 16, wherein the second part is arranged to move against a resilient bias to increase the size of the outlet.

19. A fluid mixing device according to claim 16, wherein increasing flow of the second fluid is arranged to urge the second part away from the first part to increase the size of the outlet.

20. A fluid mixing device according to claim 16 further comprising a valve configured to feed the second fluid to the dispersing member.

* * * * *